United States Patent [19]

Coblentz

[11] Patent Number: 4,737,069

[45] Date of Patent: Apr. 12, 1988

[54] METHOD OF TRANSPORTING BAGGED CARGO

[76] Inventor: W. Sam Coblentz, P.O. Box 381708, Germantown, Tenn. 38183-1708

[21] Appl. No.: 775,446

[22] Filed: Sep. 12, 1985

Related U.S. Application Data

[63] Continuation-in-part of Ser. No. 578,621, Feb. 9, 1984, abandoned, and a continuation-in-part of Ser. No. 572,735, Jan. 12, 1984, abandoned, and a continuation-in-part of Ser. No. 525,984, Oct. 17, 1983, abandoned.

[51] Int. Cl.[4] ..... B66C 1/18

[52] U.S. Cl. ..... 414/786; 294/74; 294/81.56; 414/43; 414/97; 414/393

[58] Field of Search ..... 414/28, 43, 97, 393, 414/398, 786; 294/67.4, 67.41, 74, 75, 81.55, 81.56

[56] References Cited

U.S. PATENT DOCUMENTS

| | | | |
|---|---|---|---|
| 3,021,166 | 2/1962 | Kempel | 294/74 |
| 3,829,144 | 8/1974 | Nattrass | 294/74 |
| 4,185,862 | 1/1980 | Slocombe | 294/74 |
| 4,432,689 | 2/1984 | Shell | 294/74 X |

FOREIGN PATENT DOCUMENTS

| | | | |
|---|---|---|---|
| 561939 | 11/1957 | Belgium | 294/74 |
| 2213758 | 9/1973 | Fed. Rep. of Germany | 294/74 |
| 1460399 | 10/1966 | France | 206/442 |
| 263366 | 12/1926 | United Kingdom | 294/74 |
| 1059070 | 2/1967 | United Kingdom | 294/74 |
| 662475 | 5/1979 | U.S.S.R. | 294/74 |

*Primary Examiner*—Leslie J. Paperner
*Attorney, Agent, or Firm*—Keaty & Keaty

[57] ABSTRACT

A method of transporting bagged cargo is disclosed. The method comprises the steps of placing elongated bags on a strap with the transverse midline of each bag aligned on or over the strap. The strap is then fastened around the sides and over the top of the bags, therefore forming a matrix. The matrix is lifted by applying an upward and inward lifting force to the straps which contain the matrix, therefore unitizing the bags. In preferred embodiments, the height of the matrix is greater than or equal to 0.7 times the width of the matrix. In other embodiments, an intermediate cross strap is provided to unitize the bottom half of the matrix separately from the top half. The resulting method permits a great number of bags to be efficiently transported to transshipment points with greatly reduced manpower and at reduced cost.

14 Claims, 5 Drawing Sheets

METHOD OF TRANSPORTING BAGGED CARGO

CROSS REFERENCE TO RELATED APPLICATIONS

This is a continuation-in-part of U.S. patent applications Ser. No. 578,621, filed Feb. 9, 1984, Ser. No. 572,735, filed Jan. 12, 1984 and Ser. No. 525,984, filed Oct. 17, 1983, all now abondoned.

BACKGROUND OF THE INVENTION

1. Field of the Invention

This invention concerns a method for transporting bagged cargo. It is more particularly related to an inter-modal method for efficiently transporting bagged cargo from the bagging point of origination to an oceangoing vessel.

2. General Discussion of the Background

Many kinds of materials are transported in bags made of burlap, polyester or other materials. Such bags are particularly appropriate for transporting loose, particulate matter such as flour, grain and seed. An inherent problem with transporting bagged cargo, however, is the cost associated with manually loading and unloading bags into transportation vehicles. This drawback has become especially troublesome as labor costs have risen in recent years, and these rising costs have been reflected in the cost of the goods being transported.

In the prior art, cargo was typically placed in bags at a processing plant, and then manually loaded into a box car (or other transportation vehicle) as loose, individual units. The box car was then transported to a terminus point, where the bags were then manually removed from the box car and hand stacked on pallets at the terminus point (usually an ocean port). The pallet could then be placed in a dockside warehouse awaiting the arrival of an oceangoing vessel. The pallet would then be lifted on to the vessel and lowered into the hold. At this point Stevedoring labor was required to remove the loose bags from the pallet and hand stack them. This method often required the use of many individual pallets which were of small dimensions, thereby allowing only a limited number of bags to be transported per pallet.

It is an object of this invention to provide a method of transporting bagged cargo in which large numbers of bags can be transported as a unitized package.

Another object of the invention is to eliminate the necessity for manual removal of the bags from a transportation vehicle and hand stacking of them on individual pallets, and then hand stacking from the pallets into the hold of a vessel.

Another object of the invention is to provide a method that will greatly reduce the cost of transportation of bagged cargo by reducing the amount of manual labor required.

Yet another object of the invention is to provide a more rapid means of transporting bagged cargo.

Still another object of the invention is to provide a method which permits the formation of well defined units of bags that retain a rectilinear shape and fit into transportation vehicles, barges and ships to fully utilize spaces being used for transport.

Finally, it is an object of the invention to provide an inter-modal transportation system in which unitized matrices of bags are formed, each matrix retaining its shape during all phases of transportation once it is formed.

SUMMARY OF THE INVENTION

The aforementioned objects are achieved by first providing a plurality of elongated bags containing cargo, each bag having top and bottom faces and a transverse midline. The present method employs a sling comprised of a continuous strap having a middle portion and two end portions. A plurality of bags are placed on the middle portion of the strap to form a bottom row of bags, the transverse midline of each bag being aligned with the strap. A plurality of rows are then formed on top of the bottom row to construct a matrix having a uniform height, the height of the matrix being greater than or equal to 0.7 times the width of the matrix. In preferred embodiments, the height of the matrix is greater than or equal to 0.706 times the width of the matrix, but more preferably the height of the matrix is greater than or equal to the width of the matrix. The single strap is then pulled up along the sides of the matrix, and the free ends of the strap interconnected with a top strap that fits over the top row of bags in the matrix. A lifting force is then applied to the free end portions of the straps, but it is necessary that the lifting force have upward and inward components to unitize the matrix and allow it to be lifted as a uniform load that retains its dimensions. A plurality of matrices can be formed in adjacent relationship to each other with the transverse edges of the bags touching, and each of the matrices can be lifted at the same time to lift a large number of bags simultaneously.

In preferred embodiments, an intermediate cross strap is provided over an intermediate row of bags in the matrix, this cross strap being tightened to help maintain the rectilinear shape of the matrix as it is being formed and before and after the lifting force is applied.

It is especially advantageous to form each row of the matrix in an interlocking fashion so that the longitudinal edges of at least two adjacent bags overlap, thereby creating a "shingle" effect which more effectively retains the rectilinear shape of the matrix.

A pair of parallel upright poles are provided in a truck on a pallet, the parallel poles forming a U-shaped receptacle. The continuous strap is then configured to fit within the U-shaped area with the middle portion of the strap spanning the pallet between the poles, and the end portions extending upwardly along them. Each pole supports a free end of the end portions in spaced relationship to the pallet surface. The matrix can then be formed between the uprights which indent the sides of the bags to help prevent them from moving during transportation in a truck or other vehicle.

In the preferred embodiment of this invention, the bags are manufactured at a processing plant, whereupon they are loaded on to pallets between the uprights which have already been fitted with the continuous strap. The truck containing the pallet is then driven to a remote location such as an ocean port where the bags are removed from the truck by simply lifting a plurality of adjacent slings simultaneously, thereby eliminating the costly and time consuming necessity for manual removal of individual bags. The plurality of adjacent matrices can then be neatly loaded into a river barge since the matrices retain their shape while being lifted. All of the matrices in the river barge can then be lifted substantially simultaneously and placed into the hold of a ship for transportation to distant points.

In alternate embodiments, the pallet is removed from the truck with the bags stacked on it. The pallet can then be stored in a warehouse until it is convenient to load them into a ship or other transshipment vehicle. The sling load can then be lifted from the pallet in a unitized matrix as described above.

DETAILED DESCRIPTION OF THE PREFERRED EMBODIMENT

The following detailed description is being made in accordance with requirements of law which demand that the best mode of making and using the invention be fully disclosed. This disclosure is obviously not intended to limit the scope of the invention, which is more appropriately construed in accordance with the appended claims.

Figure 1:
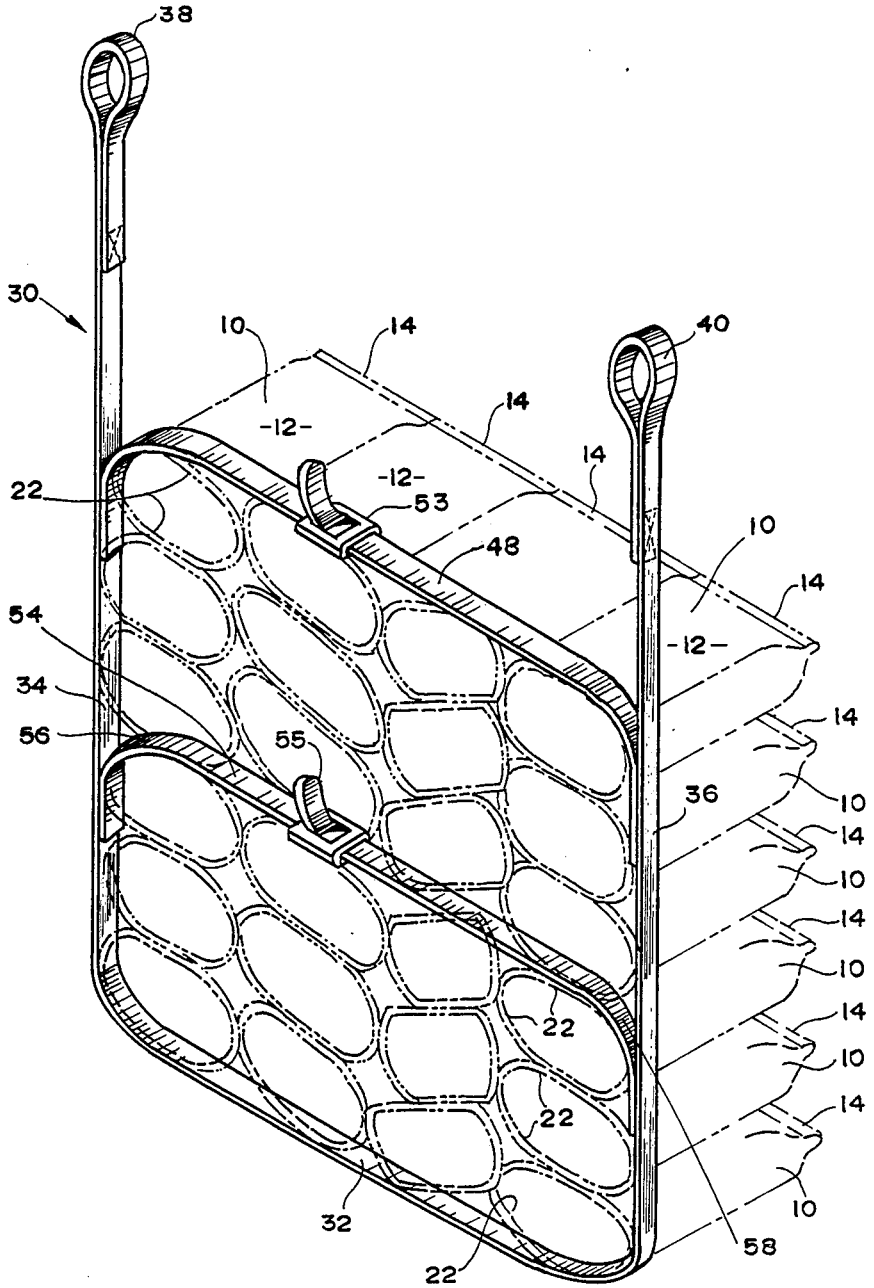
FIG. 1 is a perspective view of the continuous strap used to form the matrix of the present invention, one-half of the bags containing the cargo being shown in phantom, each bag being shown only from its transverse midline to one transverse end thereof.
Figure 2:
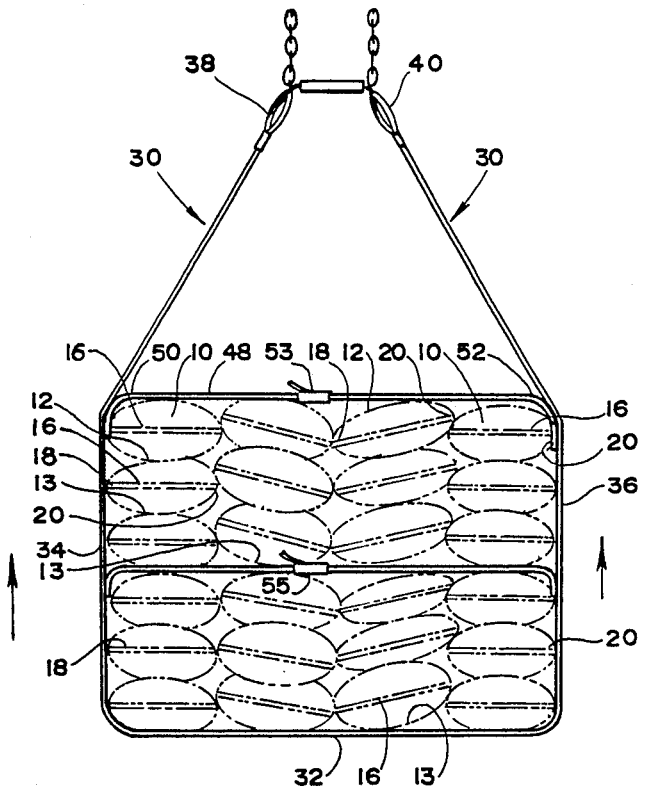
FIG. 2 is a view of the strap of FIG. 1 being lifted to transport a large number of bags simultaneously.

A method of transporting bagged cargo comprises the steps of first providing a plurality of elongated bags 10 each having a top face 12 and an opposing, bottom face 13 (FIG. 2). Each bag also has a pair of parallel transverse edges 14, 16 (FIGS. 1 and 2), parallel longitudinal edges 18, 20 (FIG. 2) and a transverse midline 22 (FIG. 1).

Figure 3:
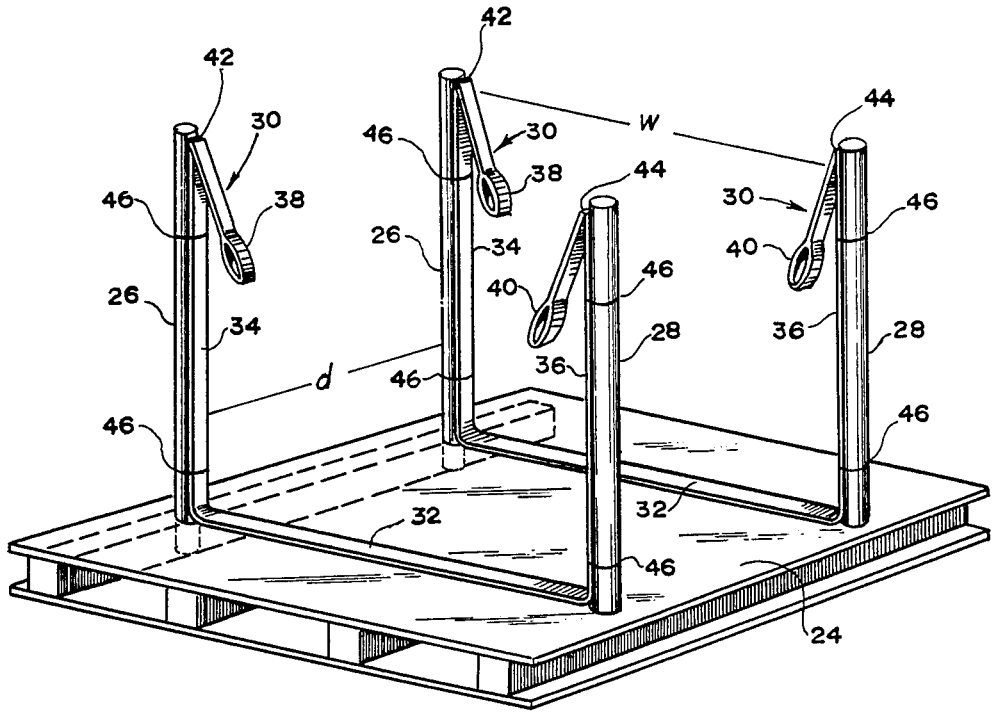
FIG. 3 is a perspective view of a first embodiment of a pallet on which the matrices are formed.

As shown in FIG. 3, a pallet 24 is provided, the width of pallet 24 being substantially equal to or less than the width of a truck bed in which the bagged cargo is to be transported. The width of the pallet must be sufficient to allow it to be placed on the flatbed of a truck trailer or in an open top van type truck trailer. A plurality of pallets 24 can be placed in edge to edge relationship to one another along the length of the truck bed to form a larger pallet. A plurality of successive pairs of parallel, opposing uprights 26, 28 are inserted into holes provided in the surface of pallet 24, the uprights 26, 28 forming a U-shaped receptacle aligned in parallel relationship with an adjacent pair of uprights. Successive pairs of uprights 26, 28 are separated by a distance d substantially equal to the length of bags 10 being transported. In the especially preferred embodiment described herein, uprights 26, 28 are separated by a width w substantially equal to the transverse width of four bags 10. The transverse width of the bags is defined herein to be the width between the upright straps that are lifting the matrix described below. In other words, if the strap indents the bags where it fits against them, the width is measured from indentation to indentation, and not from the original edges of the bag.

A strap 30 is provided, the strap 30 being comprised of a central portion 32, first end portion 34 and second end portion 36. Each end portion 34, 36 is provided with a loop 38, 40 (see especially FIG. 1). A plurality of such straps 30 is provided, and each is conformed into a U-shaped configuration with the central portion 32 of each U spanning the distance between uprights 26, 28, first end portion 34 fitting adjacent and in contiguous relationship against first upright 26 and second end portion 36 fitting adjacent and in contiguous relationship against second upright 28. As shown best in FIG. 3, each end portion is attached at points 42, 44 to its respective upright by a hook, string, rubber band or other suitable means 46 to hold loops 38, 40 in spaced relationship to the surface of pallet 24. Rubber bands 46 are also tied around each upright and end portion to hold the end portion of the strap flat against the upright. The resulting structure is a plurality of parallel, U-shaped receptacles each containing a U-shaped single strap.

Figure 7:
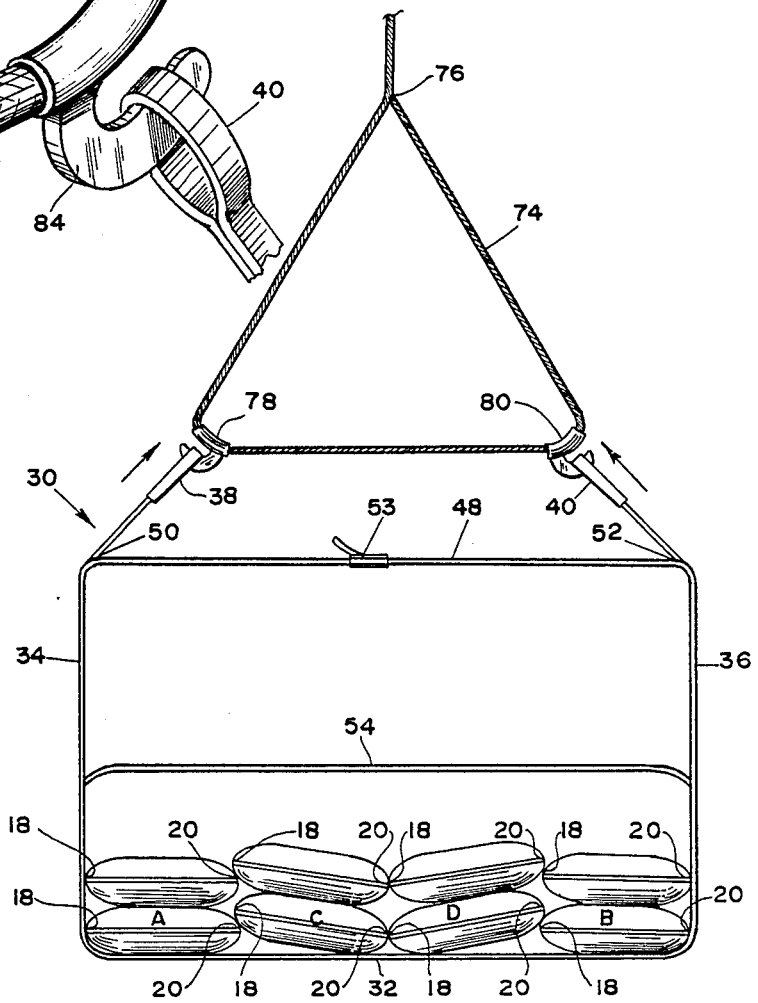
FIG. 7 is a view of the sliding hook in use.

Turning now to FIG. 7, the preferred method of forming each matrix will be described. The bottom row of the matrix is preferably comprised of four bags placed on central portion 32 of strap 30. It is important to the operation of the present invention that the transverse midline (22 in FIG. 1) of each bag 10 be placed on the strap. The row is formed in interlocking fashion by placing a first bag A at a first end of a central portion 32 adjacent strap 34, then placing a second bag B at a second end of central portion 32 adjacent strap 36. A third bag C is then placed adjacent first bag A with longitudinal edge 18 of third bag C in overlapping relationship to longitudinal edge 20 of first bag A. A fourth bag D is then placed adjacent second bag B with longitudinal edge 20 of fourth bag D overlapping longitudinal edge 18 of second bag B.

A matrix of bags is then formed within strap 30 while the straps are attached to the uprights as shown in FIG. 3. Each successive row of the matrix is formed in the same fashion as that described in connection with bags A, B, C, D in FIG. 7. In order to prevent bowing of the bags into a half moon or inverted pyramid shape when the matrix is lifted, the height of the matrix should be greater than or equal to 0.7 times the width of the matrix. More particularly, it has been found that the height should be greater than or equal to 0.706 times the width of the matrix, and in especially preferred embodiments, the height of the matrix is greater than or equal to the width. When these dimensions are observed, the matrix retains its rectilinear shape during lifting. If these dimensions are not observed, the outside bags of the matrix tend to lift up relative to the inside bags, thereby forming an inverted pyramid shape which is inherently unstable and tends to fall apart when placed back on the ground or other flat surface. The inverted pyramid shape also interrupts the regular geometry of the matrix, and would bring about a less efficient utilization of space in transport vehicles and ships.

In preferred embodiments, a top cross strap 48 (FIGS. 1 and 7) is placed between end portions 34, 36 of strap 30 below loops 38, 40. Cross strap 48 is preferably formed with ends 50, 52 which are arcuate and conform to the rounded sides of bags 10 contained therebeneath.

It is important that cross strap 48 not extend straight across the tops of bags 10 in the unlifted condition since strap 30 is elongated when lifted, thereby tending to move ends 50, 52 upwardly and away from and out of contacting relationship with bags 10. If, however, ends 50, 52 of cross strap 48 are curved downwardly, this upward movement will not move cross strap 48 out of frictionally engaging relationship with the top row of bags. Top cross strap 48 is connected over the top row of bags by an interlocking buckle 53 which can tighten the strap down on top of the bags once the matrix is formed. Similarly, the buckle can release the ends of cross strap 48 from one another when it is time for the matrix to be disassembled.

In especially preferred embodiments, an intermediate cross strap 54 is provided (FIGS. 1 and 7) at about half the height of the matrix. As seen best in FIG. 1, intermediate cross strap 54 fits in contiguous relationship over the tops of a row of bags intermediate the top and bottom of the matrix. Intermediate cross strap 54 has ends 56, 58 which at least partially conform in shape to the sides of the first and second bags adjacent straps 34, 36. It is important for strap 54 to have a downwardly sloping configuration at its ends. If the strap extended straight across the row of bags, the elongation of straps 34, 36 during lifting would cause ends 56, 58 to lift upwardly and push the bags above it into an unstable, inverted pyramid configuration. An interlocking buckle 55 allows strap 54 to be tightened in place over the intermediate row of bags as the matrix is being formed to help it retain its shape.

A transport matrix is next formed by erecting a plurality of successive matrices within successive pairs of uprights on pallet 24. A simultaneous lifting force is then applied to the loops 38, 40 of end portions 34, 36, the lifting force having upward and inward components. This kind of lifting force is provided by a triangular lift 60 supported at a top apex by an elongated circular beam 62 that spans the length of truck 64 from which the matrix is being lifted. Lift 60 is comprised of a plurality of chains 66 looped over the top of beam 62. Each of chains 66 is provided at each of its bottom apices with a sliding hook 68, 70 which is hooked through loops 38, 40 respectively. The hooks are separated by a spacer 72 which defines a minimum distance between hooks 68, 70. The hooks can be slidably disposed on chain 66 so that they move towards and away from each other along chain 66. Their minimum distance, however, can be governed by the length of an optional spacer 72. It is important in the operation of the present invention that the length of spacer 72 be less than the width of the matrix. If this dimensional relationship is adhered to, the lifting force exerted on portions 34, 36 of strap 30 will be both upward and inward. Merely lifting portions 34, 36 directly vertically upward will tend to prevent the matrix from being unitized, thereby destabilizing it and causing it to assume a half moon or inverted pyramid shape.

Figure 6:
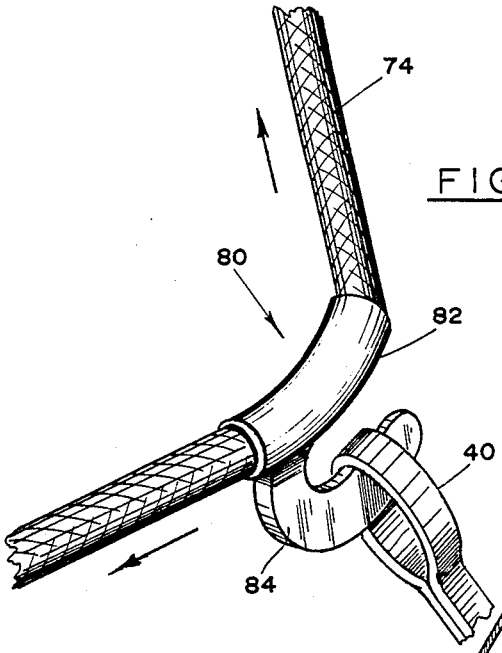
FIG. 6 is an enlarged, fragmentary view of a sliding hook which provides upward and inward components of lifting force for lifting the strap that contains the matrix.

An alternate embodiment of triangular lift 60 is shown in FIGS. 6 and 7. The triangular lift in this embodiment is seen to be comprised of a cable 74 having a top apex 76 and a pair of lower apices defined by a sliding hook 78, 80. As seen in more detail in FIG. 6, the sliding hook is comprised of a tube 82 which fits in sliding relationship around cable 74, and a depending hook portion 84 which is inserted through loop 40. A spacer is not required on this embodiment.

Figure 4:
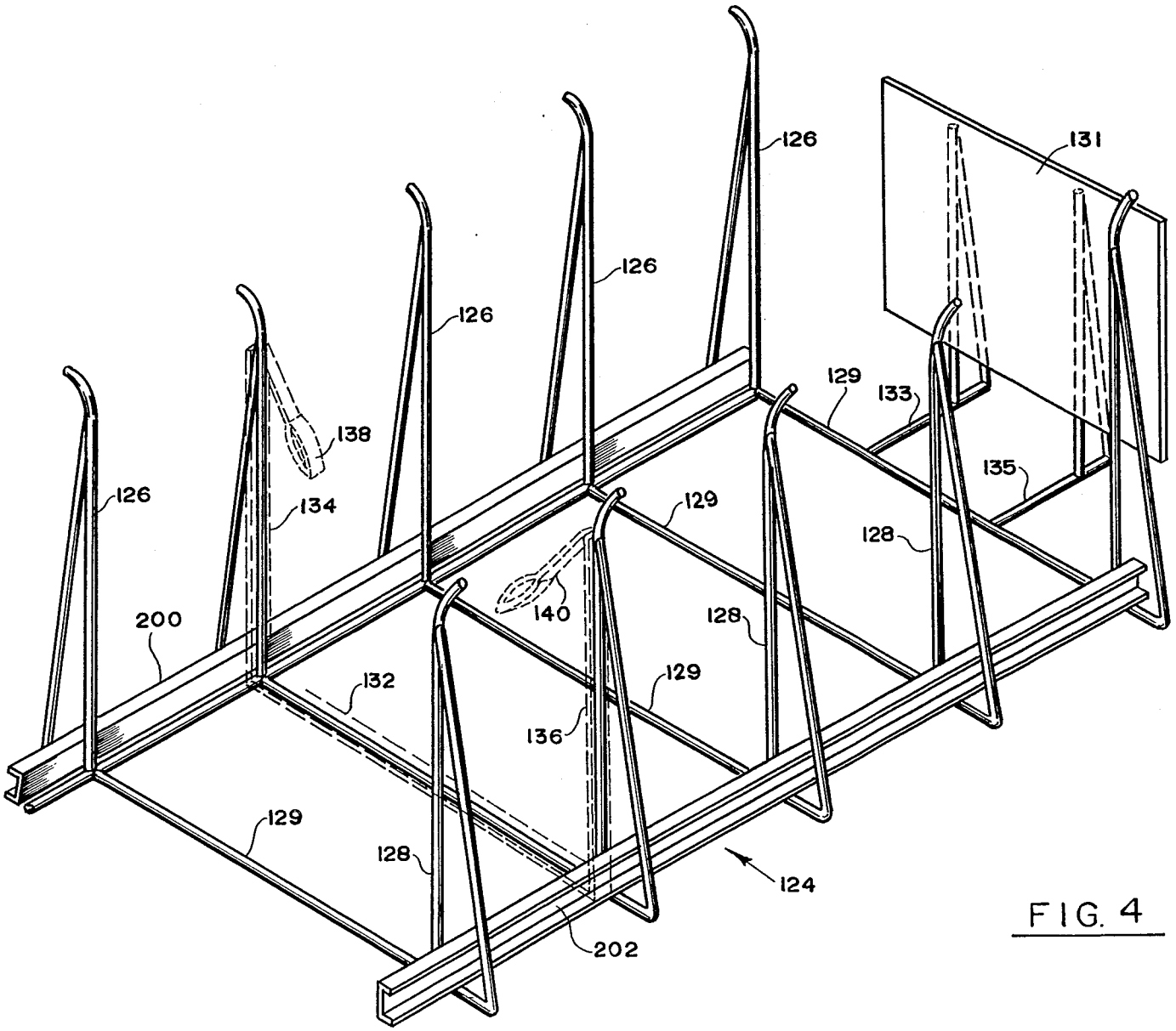
FIG. 4 is a second embodiment of a pallet on which the matrices are formed, the pallet being of substantially the same dimensions as the flatbed of a truck in which the bagged cargo is to be transported.

An alternate embodiment of pallet 24 is shown in FIG. 4. This pallet is similar to that shown in FIG. 3, and like parts have been given like reference numerals plus 100. The wooden base of FIG. 3 has, however, been replaced by a pair of parallel I-beams 200, 202 which extend substantially the length of the flatbed of a truck. The I-beams provide structural support for the pluality of U-shaped structures which are comprised of uprights 126, 128 and spacer 129. A support plate 131 is also provided at one end of pallet 124, and is held in spaced relationship thereto by a pair of structural arms 133, 135.

One of the purposes of the uprights 26, 28 in FIG. 3 and 126, 128 in FIG. 4 is to provide a surface which slightly indents the outermost bags of the matrix as the matrix is being formed. This slight indentation provides frictional engagement against the bag which helps retain the bag in a fixed position during transportation of the matrix in a truck. Maintenance of this fixed position is helpful since movement of the bags will tend to degrade the rectilinear form of the matrix and reduce its stability. Although it is possible to form the matrix against flat walls instead of uprights, preferred embodiments employ the uprights because of the advantages of the frictional engagement set forth above.

Figure 5:
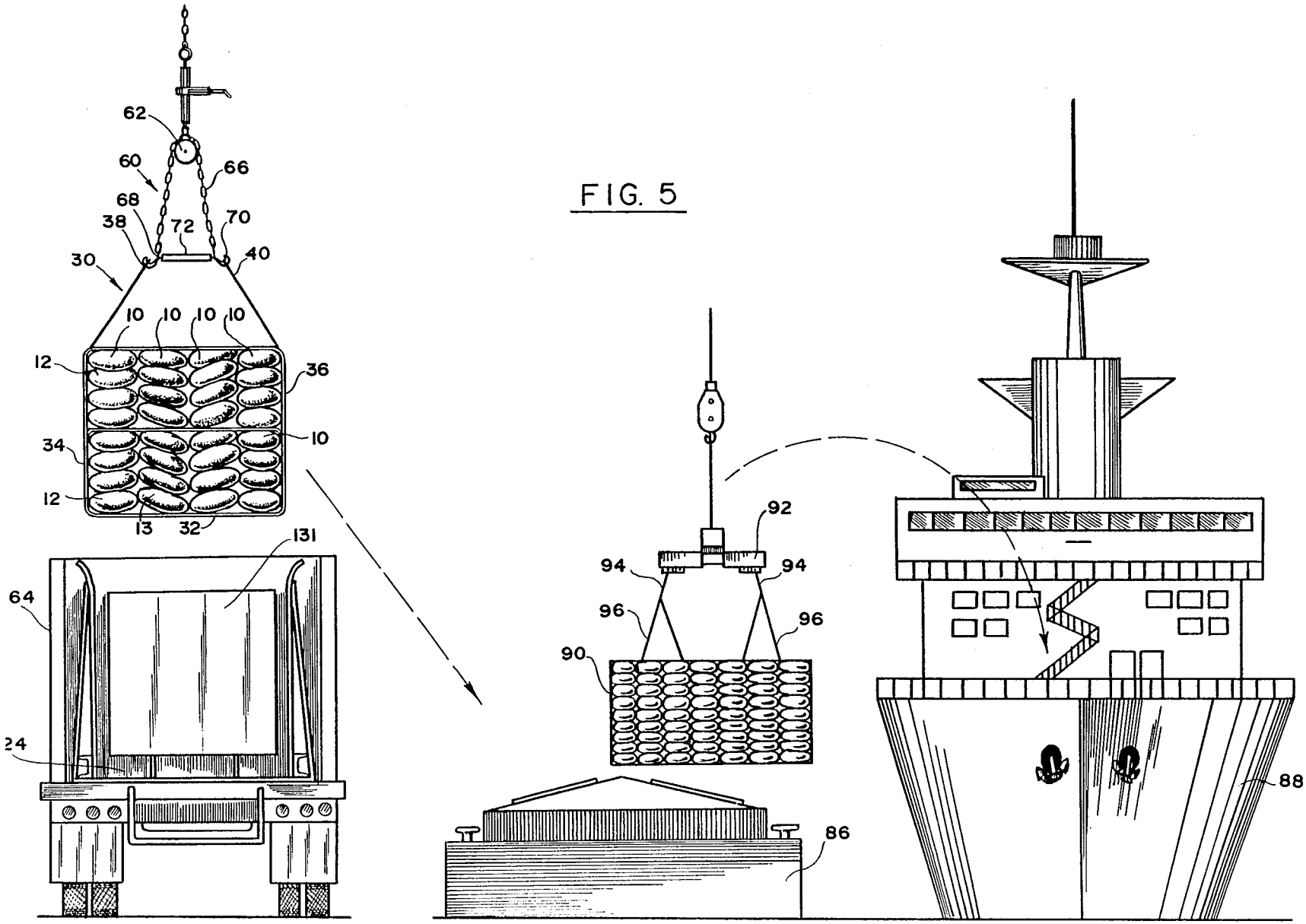
FIG. 5 is a schematic view of the inter-modal transportation system of the present invention showing a plurality of adjacent matrices being lifted out of the truck and placed into a barge, all of the matrices from the barge then being simultaneously lifted out of the barge and placed into the hold of a ship once the barge has reached the ship.

The overall operation of the inter-modal transportation method is best seen in FIG. 5. The transport vehicle such as truck 64 is loaded with the bags at an origination point, typically the factory where the bags are filled and closed. A plurality of adjacent matrices are formed within pallet 124, thereby forming what is called herein a transport matrix. A typical transport matrix is formed of fifteen adjacent matrices, each matrix having its own strap 32. The truck 64 is then driven from the factory to a desired destination such as an ocean port or river terminal. The transport matrix (which is comprised of a plurality of individual matrices) is then substantially simultaneously lifted by applying a lifting force to beam 62 which extends the length of truck 64. As beam 62 is lifted, an upward and inward lifting force is imparted to loops 38, 40 of strap 30, thereby forming a unitized matrix which is lifted as a unit from truck 64. It is important to note that pallet 124 remains in truck 64 for reuse, thereby eliminating the necessity for a pallet accompanying each sling load as in the prior art. The unitized matrix can then be placed as a self-standing, stable unit in either a warehouse or a barge 86. The transport matrix and its individual matrices remain free standing while top cross strap 48 remains buckled. Even if the lifting force is no longer applied, the transport matrix will retain its rectilinear, stable shape that will not collapse or fall over as long as top cross strap 48 remains buckled.

During lifting of the transport matrix, several levels of stabilizing support are provided for retaining the rectilinear integrity of the transport matrix. Each matrix is supported by the strap around it and by the interlocking bags of each row on a larger scale, each adjacent matrix provides support for every matrix.

A plurality of transport matrices can be placed in barge 86, and barge 86 then moved to a position adjacent ship 88. A plurality of transport matrices can then simultaneously be lifted to form a self supporting water transportation matrix 90, and that matrix 90 is then placed in the hold (not shown) of ship 88. The simultaneous lifting force is applied to matrix 90 by a lift 92 having a length substantially equal to the length of matrix 90. Each lift 92 is provided with a plurality of vertical chains 94 each of which is attached in turn to a triangular lift 96 similar to lift 60. It should be noted that FIG. 5 is an end view of matrix 90, and accordingly shows only a pair of chains 94 and a pair of lifts 96. It should be understood, however, that a plurality of identical lifts are aligned one in back of the other along the length of matrix 90, one lift being provided for each individual matrix within the individual straps 30.

I claim:

1. A method of transporting bagged cargo comprising the steps of:

providing a plurality of elongated bags containing cargo, each bag having top and bottom faces and a transverse midline;

providing a sling comprised of a continuous strap having a middle portion and two end portions;

placing a plurality of bags on the middle portion of the strap to form a bottom row with a transverse midline of each bag aligned with the strap;

forming a plurality of rows on top of the bottom row to form a matrix having a substantially uniform height, the height of the matrix being greater than or equal to 0.7 times the width of the matrix, the matrix being contained between the end portions of the strap which project upwardly along each side of the matrix, wherein a bottom row of the matrix is four bags wide, the bags being placed on the central portion of the continuous strap in interlocking fashion by placing a first bag at one end of the central portion and a second bag at the other end of the central portion, then placing a third bag adjacent the first bag with the longitudinal edge of the third bag in overlapping relationship to the longitudinal edge of the first bag, then placing a fourth bag adjacent the second bag with the longitudinal edge of the fourth bag overlapping the longitudinal edge of the second bag;

providing a top cross strap between the end portions of the continuous strap, and securing the top cross strap in contiguous relationship over the top of the matrix;

providing an intermediate cross strap between the end portions of the continuous strap, and securing the intermediate cross strap in contiguous relationship over the top faces of an intermediate row of bags in the matrix, wherein the top and intermediate cross straps are each attached to the end portions of the continuous strap at positions intermediate the top and bottom faces of the row of bags over which the strap fits so that the cross straps conform to at least part of the size of the bags adjacent the end portions and wherein each row of bags is formed in interlocking fashion with some of the longitudinal edges overlapping;

providing a pallet with a pair of parallel uprights, and forming the matrix between the uprights with the longitudinal edges of the outermost bags of the matrix in abutting frictionally engaging relationship to the uprights and wherein the end portions of the continuous strap are supported above the pallet by the uprights, and the intermediate portion is on the pallet between the uprights; and applying a lifting force to the end portions of the strap, the lifting force having upward and inward components to unitize the matrix and allow it to be lifted as a uniform load that retains its dimensions, with the lifting force being applied by a triangular lift supported at a top apex by a means for lifting the triangular lift, the other two apices of the triangle each being formed by a sliding hook on a cable, the sliding hooks being held in spaced relationship by a spacer.

2. The method of claim 1 wherein each successive row of the matrix is formed in interlocking fashion.

3. The method of claim 2 wherein a plurality of adjacent slings are provided, and a matrix is formed in each sling, the distance between each adjacent sling being substantially equal to the length of each bag so that each matrix abuts an adjacent matrix in supporting relationship to form a transport vehicle matrix.

4. The method of claim 3 wherein the transport matrix is formed in a transport vehicle.

5. The method of claim 4 wherein the transport vehicle is moved to a desired destination, and the plurality of adjacent slings are lifted substantially simultaneously as a transport matrix from the transport vehicle.

6. The method of claim 5 wherein the transport matrix is placed in a warehouse.

7. The method of claim 5 wherein the transport matrix is placed in a barge with a plurality of other transport matrices and moved to a ship, a plurality of transport matrices then being simultaneously lifted to form a self-supporting water transportation matrix, the water transportation matrix then being placed in a hold of the ship.

8. The method of claim 7 wherein the height and width of the matrix are made substantially equal.

9. The method of claim 7 wherein the height of the matrix is made greater than the width.

10. A method of transporting bagged cargo, comprising the steps of:

providing a plurality of elongated bags each having top and bottom faces, a pair of parallel transverse edges, parallel longitudinal edges, and a transverse midline circumscribing its center;

providing a pallet in a transport vehicle with a plurality of successive pairs of parallel opposing uprights, each of which forms a U-shaped receptacle aligned in parallel relationship with the adjacent pair of uprights, the successive pairs of uprights being separated by a distance substantially equal to the length of the bags to be transported, each upright of the pair being separated by a width substantially equal to the transverse width of four bags;

providing a plurality of continuous straps comprised of a central portion, a first end portion and a second end portion, and conforming each strap into a U-shaped configuration with the central portion of each U spanning the distance between the uprights of a pair, the first end portion being conformed to fit against the first upright and the second end portion being conformed to fit against a second upright, and attaching each end portion to its respective upright to hold it in spaced relationship to the pallet;

forming a bottom row of a matrix by placing four bags on the central portion of the strap with the transverse midline of each bag aligned with the strap, the row being formed in interlocking fashion by placing a first bag at a first end of the central portion adjacent the first upright, and placing a second bag at a second end of the central portion adjacent the second upright, then placing a third bag adjacent the first bag with the longitudinal edge of the third bag in overlapping relationship to the longitudinal edge of the first bag, then placing a fourth bag adjacent the second bag with the longitudinal edge of the fourth bag overlapping the longitudinal edge of the second bag;

forming a matrix of a plurality of rows of bags formed in the same manner as the bottom row and wherein the height of the matrix is greater than or equal to 0.706 times the width of the matrix, the matrix being contained between the end portions of the continuous straps which are conformed to fit against the uprights;

placing a cross strap between the end portions of the matrix, the strap extending in contiguous relationship over a top row of bags of the matrix and at least partially over the sides of the first and fourth bags adjacent the uprights;

forming a transport matrix by forming a plurality of successive matrices within successive pairs of uprights, then applying a simultaneous lifting force to the end portions of successive straps, the lifting force having upward and inward components, the lifting force being provided by a triangular lift supported at a top apex by a means for lifting the triangular lift, the two other apices of the triangle each being formed by a sliding hook on a cable, the sliding hooks being held in spaced relationship by a spacer;

moving the transport vehicle to a desired destination, and substantially simultaneously lifting the plurality of adjacent straps as a unitized matrix from the transport vehicle, then placing the transport matrix in a barge with a plurality of other transport matrices and moving the barge to a ship, a plurality of transport matrices then being simultaneously lifted to form a self supporting water transportation matrix, the water transportation matrix then being placed in a ship.

11. The method of claim 10 further comprising the step of providing an intermediate strap between the end portions, the intermediate strap fitting in contiguous relationship over the tops of a row of bags intermediate the top and bottom of the matrix, the strap at least partially conforming in shape to the sides of the first and second bags adjacent the uprights.

12. The method of claim 11 wherein the transport matrix is stored in a warehouse prior to being moved to the barge.

13. The method of claim 12 wherein the matrix is formed of substantially equal height and width.

14. The method of claim 12 wherein the height of the matrix is greater than the width.

* * * * *